US009487372B2

(12) United States Patent
Weng et al.

(10) Patent No.: US 9,487,372 B2
(45) Date of Patent: Nov. 8, 2016

(54) FINANCIAL SELF-SERVICE EQUIPMENT AND IMPELLER TYPE PAPER MONEY SEPARATION DEVICE THEREOF

(71) Applicant: GRG Huitong Financial Services Co., Ltd., Guangzhou, Guangdong (CN)

(72) Inventors: Qiuhua Weng, Guangdong (CN); Dong Tan, Guangdong (CN)

(73) Assignee: GRG Banking Equipment Co., Ltd., Guangzhou, Guangdong (CN)

( * ) Notice: Subject to any disclaimer, the term of this patent is extended or adjusted under 35 U.S.C. 154(b) by 0 days.

(21) Appl. No.: 14/909,825

(22) PCT Filed: Apr. 25, 2014

(86) PCT No.: PCT/CN2014/076202

§ 371 (c)(1),
(2) Date: Feb. 3, 2016

(87) PCT Pub. No.: WO2015/018212

PCT Pub. Date: Feb. 12, 2015

(65) Prior Publication Data

US 2016/0185553 A1 Jun. 30, 2016

(30) Foreign Application Priority Data

Aug. 5, 2013 (CN) ..... 2013 1 0337536

(51) Int. Cl.
*B65H 29/40* (2006.01)
*G07D 11/00* (2006.01)
(Continued)

(52) U.S. Cl.
CPC ..... *B65H 29/40* (2013.01); *B65H 29/22* (2013.01); *B65H 43/08* (2013.01);
(Continued)

(58) Field of Classification Search
CPC ..... B65H 7/14; B65H 7/18; B65H 7/20; B65H 15/00; B65H 29/20; B65H 29/22; B65H 29/38; B65H 29/40; B65H 43/00; B65H 43/02; B65H 43/04; B65H 43/08; B65H 2301/42112; B65H 2301/4212; B65H 2404/661; B65H 2404/662; B65H 2404/561; B65H 2511/51; B65H 2601/272; B65H 2701/1912
USPC ..... 271/315
See application file for complete search history.

(56) References Cited

U.S. PATENT DOCUMENTS 4,603,849 A * 8/1986 Nakamura ..... B65H 29/40 271/186
5,775,682 A * 7/1998 Hosking ..... B65H 29/40 271/119

(Continued)

FOREIGN PATENT DOCUMENTS

CN 1657385 A 8/2005
CN 101139051 A 3/2008

(Continued)

OTHER PUBLICATIONS

International Search Report, dated Jul. 24, 2014, from a corresponding International Application No. PCT/CN2014/076202.

(Continued)

*Primary Examiner* — Ernesto Suarez
(74) *Attorney, Agent, or Firm* — Wolf, Greenfield & Sacks, P.C.

(57) ABSTRACT

An impeller type banknote separation device includes a conveying impeller configured to separate banknotes, an impeller phase detecting sensor and a banknote conveying mechanism, and further includes at least one U-shaped sensor fixed on the conveying impeller and configured to detect whether a banknote enters the conveying impeller. The U-shaped sensor includes a signal transmitting end and a signal receiving end located at a same side of the conveying impeller, the signal transmitting end and the signal receiving end are spaced from each other with a certain interval and form an open end of the U-shaped sensor. The technical solution of detecting whether the banknote is inserted into the impeller by the U-shaped sensor to control the rotation of the conveying impeller has a higher accuracy compared with the conventional technology.

12 Claims, 6 Drawing Sheets

(51) Int. Cl.
*B65H 29/22* (2006.01)
*B65H 43/08* (2006.01)

(52) U.S. Cl.
CPC .. *G07D 11/0081* (2013.01); *B65H 2301/4474* (2013.01); *B65H 2301/44765* (2013.01); *B65H 2404/661* (2013.01); *B65H 2553/81* (2013.01); *B65H 2701/1912* (2013.01)

(56) References Cited

U.S. PATENT DOCUMENTS

| | | | | |
|---|---|---|---|---|
| 6,554,273 | B1 * | 4/2003 | Holland-Letz | B65H 29/40 271/176 |
| 6,796,557 | B2 * | 9/2004 | Watanabe | B65H 5/34 209/534 |
| 7,438,289 | B2 * | 10/2008 | Wada | B65H 29/40 271/176 |
| 2002/0113366 | A1 | 8/2002 | Watanabe et al. | |
| 2005/0212201 | A1 | 9/2005 | Wada | |
| 2008/0054559 | A1 | 3/2008 | Nomiyama et al. | |
| 2011/0304091 | A1 | 12/2011 | Hirano et al. | |
| 2012/0298477 | A1 | 11/2012 | Nishida et al. | |
| 2014/0346093 | A1 | 11/2014 | Matsuura et al. | |

FOREIGN PATENT DOCUMENTS

| | | | |
|---|---|---|---|
| CN | 101734526 | A | 6/2010 |
| CN | 102044109 | A | 5/2011 |
| CN | 102439634 | A | 5/2012 |
| CN | 103177504 | A | 6/2013 |
| CN | 103400442 | A | 11/2013 |
| JP | 2007055751 | A | 3/2007 |
| JP | 2008165376 | A | 7/2008 |
| JP | 2012247947 | A | 12/2012 |

OTHER PUBLICATIONS

Chinese Office Action, dated Dec. 22, 2014, from corresponding Chinese Patent Application No. 201310337536.8.
Written Opinion, dated Aug. 6, 2014, from corresponding International Application No. PCT/CN2014/076202.

* cited by examiner

FINANCIAL SELF-SERVICE EQUIPMENT AND IMPELLER TYPE PAPER MONEY SEPARATION DEVICE THEREOF

CROSS-REFERENCE TO THE RELATED APPLICATIONS

This application is the national phase of International Application No. PCT/CN2014/076202, titled "FINANCIAL SELF-SERVICE EQUIPMENT AND IMPELLER TYPE PAPER MONEY SEPARATION DEVICE THEREOF", filed on Apr. 25, 2014, which claims the priority to Chinese Patent Application No. 201310337536.8, titled "FINANCIAL SELF-SERVICE EQUIPMENT AND IMPELLER TYPE BANKNOTE SEPARATION DEVICE THEREOF", filed with the Chinese State Intellectual Property Office on Aug. 5, 2013, both of which applications are incorporated herein by reference in their entireties.

FIELD

The present application relates to a banknote processing equipment, and in particular to an impeller type banknote separation device and a financial self-service equipment employing the impeller type banknote separation device.

BACKGROUND

With the continuous development of economy, a processing amount of banknotes becomes larger and larger, and the requirements for a processing capacity of banknote processing devices is increased accordingly. The banknote processing devices widely used at present include an automatic teller machine, a banknote sorting machine and etc. according to main functions of the banknote processing devices. In these banknote processing devices, an impeller type banknote separation device is widely used.

The impeller type banknote separation device mainly includes an impeller, a banknote passage, an impeller position sensor, and a detection sensor for detecting whether the banknote enters. The detection sensor for the banknote is generally arranged on a passage close to the impeller. In the case that the banknote enters the impeller, the detection sensor is blocked (off), and the presence of the banknote is detected. With the rotating of the impeller, the banknote leaves the sensor, and the detection sensor is unblocked again (on). The impeller stops and waits for a next piece of banknote. Since an optical through-beam type sensor is generally used as the detection sensor for the banknote, and when the impeller rotates, unblocking the through-beam type sensor again from blocking state takes a long time, which results in a long detecting and processing time, and adversely affects a processing speed of the entire device. Additionally, in the case that the through-beam type sensor is used over a long time, the surface of the through-beam type sensor is apt to be covered by dust, which may also adversely affect the accuracy of detection.

Furthermore, since the banknote detection sensor in the conventional technology is arranged at the passage close to the impeller, the banknote detection sensor senses the banknote by sensing whether the banknote is to enter the impeller, and in fact, it cannot be ensured whether the banknote is completely inserted into the impeller. Therefore, a condition that the impeller starts to rotate when the banknote is not completely inserted in the impeller may occur, which may cause the banknote to fly off the impeller or be jammed during the delivering process.

SUMMARY

One object of the present application is to provide an impeller type banknote separation device, which has a fast processing speed and may prevent a banknote from flying off an impeller or being jammed during a conveying process of the banknote.

A financial self-service equipment is further provided according to the present application, and at least one of a banknote-in/out port and a temporary area thereof employs the above impeller type banknote separation device, thus has the advantages of a fast processing speed, and preventing a banknote from flying off the impeller and being jammed.

An impeller type banknote separation device is provided, which includes a conveying impeller configured to separate banknotes, an impeller phase detecting sensor and a banknote conveying mechanism, the conveying impeller having multiple blades uniformly distributed in a spiral radial form, where the impeller type banknote separation device further includes at least one U-shaped sensor fixed on the conveying impeller and configured to detect whether the banknote enters the conveying impeller, the U-shaped sensor includes a signal transmitting end and a signal receiving end located at a same side of the conveying impeller, the signal transmitting end and the signal receiving end are spaced from each other with a certain interval to form an open end of the U-shaped sensor, and the open end of the U-shaped sensor faces to a direction in which the banknote enters the impeller Preferably, two guiding plates are arranged at the open end of the U-shaped sensor, the two guiding plates are spaced from each other with a predetermined distance and are respectively inclined at a predetermined angle, so as to form a groove having a splayed cross-section, and the groove having the splayed cross-section comprises a groove opening having a wide opening and a groove bottom having a narrow opening, the groove opening faces to a direction in which the banknote enters the conveying impeller, and the groove bottom faces to the open end of the U-shaped sensor.

Specifically, the banknote conveying mechanism includes an O-shaped belt and a belt pulley configured to convey the banknote, and the O-shaped belt and the belt pulley form a banknote conveying passage and are powered by a stepper motor.

Preferably, a space between extension lines of tangent lines of, the two adjacent blades nearest to the banknote conveying passage of the conveying impeller, is an impeller space into which the banknote is insertable, and the impeller space intersects or overlaps with the banknote conveying passage to form a closed conveying passage.

Preferably, the impeller type banknote separation device includes a pair of conveying impellers coaxially arranged in the banknote conveying passage, and one U-shaped sensor is fixedly mounted on at least one side of each of the pair of conveying impellers.

A financial self-service equipment is provided, which includes a banknote-in/out port, a banknote discriminator, a temporary storage area, a deposit box, a circulation banknote box and a banknote conveying passage, where at least one of the banknote-in/out port and the temporary storage area is provided with an impeller type banknote separation device including a conveying impeller configured to separate banknotes, an impeller phase detecting sensor and a banknote conveying mechanism, the conveying impeller having multiple of blades which are uniformly distributed in a spiral radial form, where the impeller type banknote separation device further includes at least one U-shaped sensor fixed on the conveying impeller and configured to detect whether the banknote enters the conveying impeller, the U-shaped sensor includes a signal transmitting end and a signal receiving end located at the same side of the conveying impeller, the signal transmitting end and the signal receiving end are spaced from each other with a certain interval to form an open end of the U-shaped sensor, and the open end of the U-shaped sensor faces to a direction in which the banknote enters the impeller.

Preferably, two guiding plates are arranged at the open end of the U-shaped sensor, the two guiding plates are spaced from each other with a predetermined distance and are respectively inclined at a predetermined angle, so as to form a groove having a splayed cross-section, the groove having the splayed cross-section comprises a groove opening having a wide opening and a groove bottom having a narrow opening, the groove opening faces to a direction in which the banknote enters the conveying impeller, and the groove bottom faces to the open end of the U-shaped sensor. Specifically, the banknote conveying mechanism includes an O-shaped belt and a belt pulley configured to convey the banknote, and the O-shaped belt and the belt pulley form a banknote conveying passage and are powered by a stepper motor. Preferably, a space between extension lines of tangent lines of, the two adjacent blades closest to the banknote conveying passage of the conveying impeller, is an impeller space into which the banknote is insertable, and the impeller space intersects or overlaps with the banknote conveying passage to form a closed conveying passage. Preferably, the impeller type banknote separation device includes a pair of conveying impellers coaxially arranged in the banknote conveying passage, and one U-shaped sensor is fixedly mounted on at least one side of each of the pair of conveying impellers.

Since the U-shaped sensor is adopted to detect whether the banknote is inserted into the impeller, to control the rotation of the impeller, the impeller type banknote separation device according to the present application has a faster processing speed compared with a banknote separation device employing a normal optical through beam sensor. And since the U-shaped sensor can rotate together with the conveying impeller, and the open end of the U-shaped sensor faces towards the direction in which the banknote enters the impeller, that is to say, the U-shaped sensor is arranged in such a way to ensure the banknote enters the U-shaped sensor, that is the banknote is completely inserted into the impeller. Thus, the technical solution of detecting whether the banknote is inserted into the impeller through the U-shaped sensor to control the rotation of the conveying impeller has a higher accuracy compared with the conventional technology, thereby preventing the banknote from flying off the impeller or being jammed during the rotation of the impeller in the case that the banknote is not completely inserted in the impeller. Further, the guiding plate is arranged at the open end of the U-shaped sensor, and the guiding plates form the groove having the splayed cross-section, thereby facilitating guiding the banknote into the U-shaped sensor. Moreover, the closed conveying passage is formed between the banknote conveying passage and the impeller space, thus further preventing the banknote from flying off the conveying impeller.

DETAILED DESCRIPTION

For further illustrating the impeller type banknote separation device according to the present application, preferable embodiments of the present application are described in detail in conjunction with drawings hereinafter.

Figure 1:
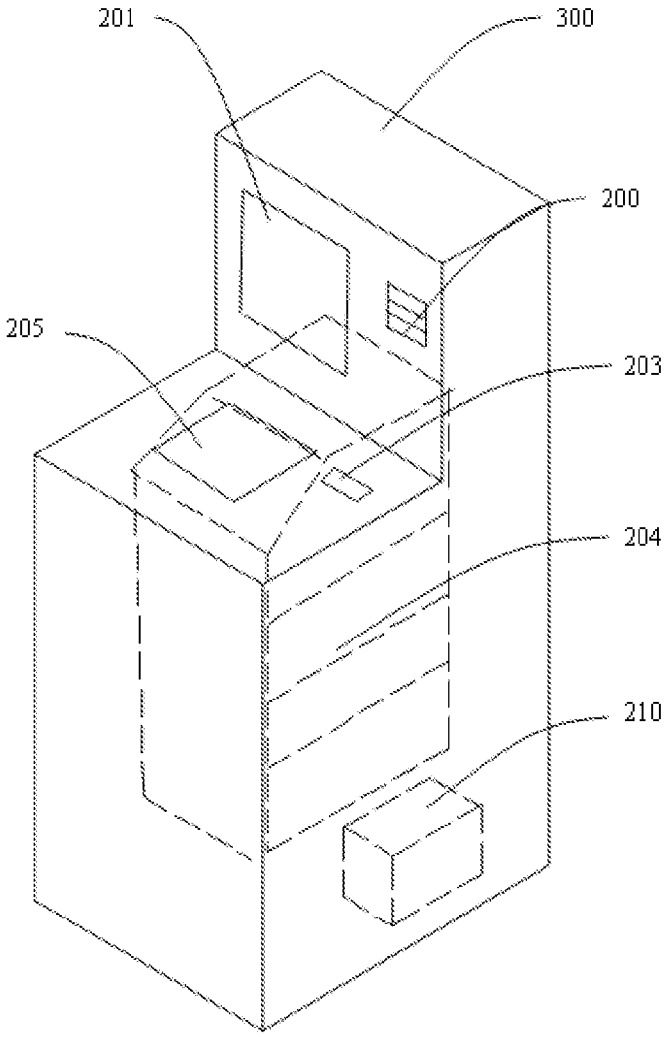
FIG. 1 is a schematic view showing the appearance of an automatic teller machine according to an embodiment of the present application.
Figure 2:
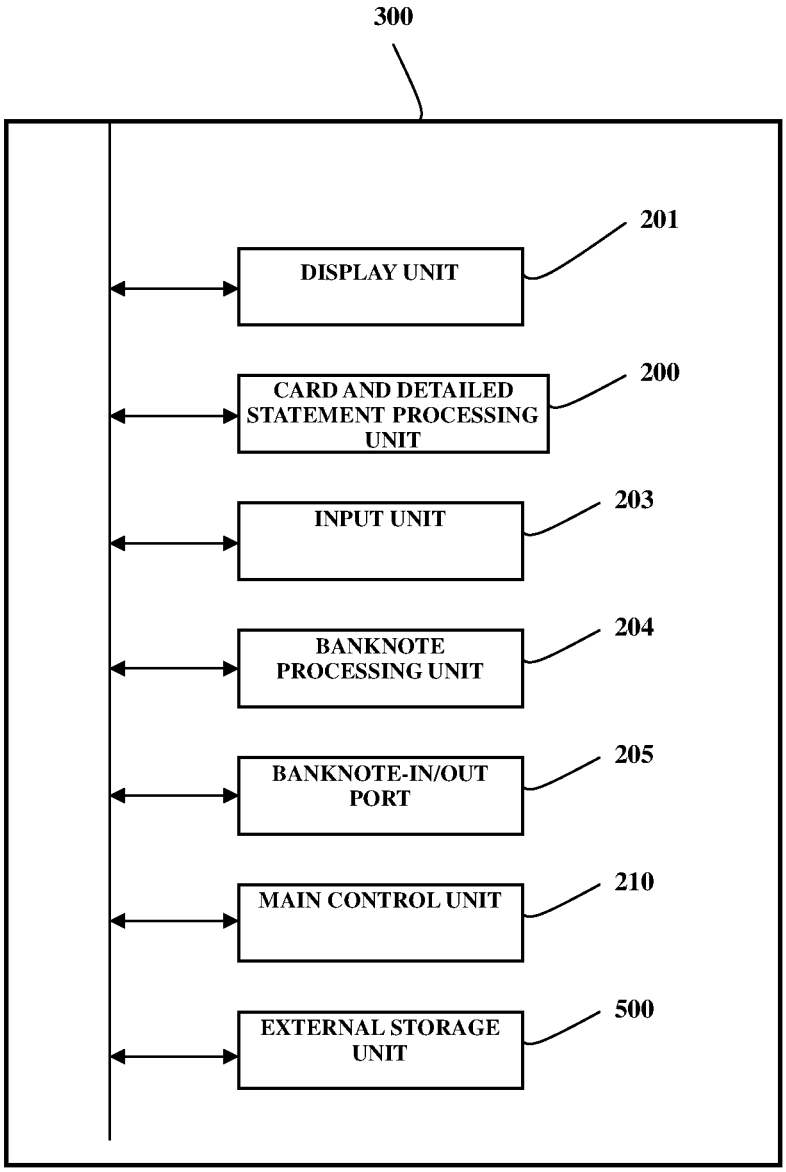
FIG. 2 is a block diagram showing a control relationship of the automatic teller machine in FIG. 1.

The main structure of a financial self-service equipment according to the present application is described by taking an automatic teller machine as an example. Referring to FIGS. 1 and 2, an automatic teller machine 300 includes a display unit 201, a card and detailed statement processing unit 200, an input unit 203, a banknote processing unit 204, a banknote-in/out port 205, a main control unit 210 and an external storage unit 500. In addition, other units that are well known in the conventional technology are also provided, and the drawings and descriptions thereof are omitted.

FIG. 2 is a block diagram showing a control relationship of the automatic teller machine 300 in FIG. 1. The banknote processing unit 204 is configured to receive a banknote placed at the banknote-in/out port 205 or discharge a banknote out of the banknote-in/out port 205 based on a banknote-in/out operation of a user. The main control unit 210 is configured to perform overall control to the automatic teller machine 300. The card and detailed statement processing unit 200 is configured to read a information of a card and issue a detailed statement. The input unit 203 is a device used by the user to input necessary information. The display unit 201 is configured to display an input interface in which various transactions can be selected. The external storage unit 500 is configured to perform a necessary data exchange.

Figure 3:
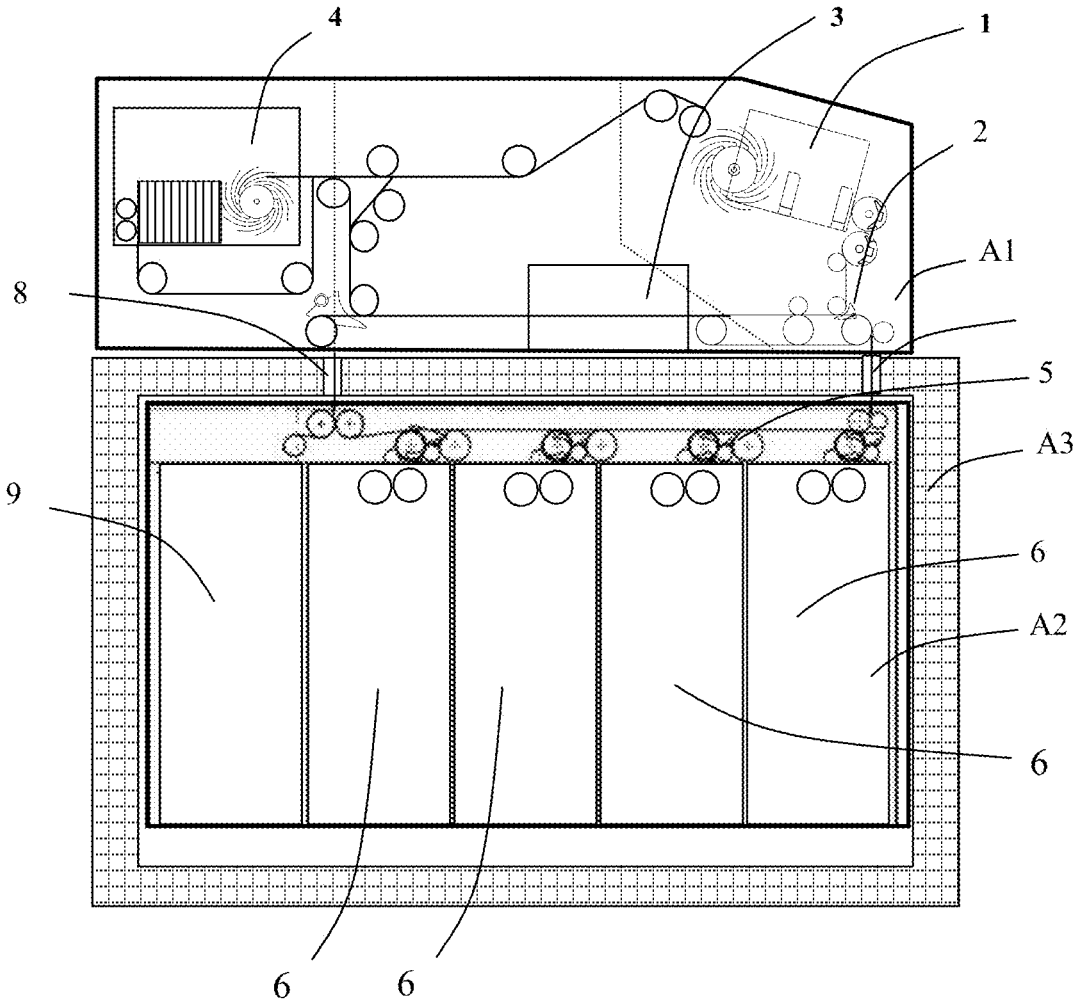
FIG. 3 is a schematic view showing a banknote processing device of the automatic teller machine in FIG. 1.

FIG. 3 is a schematic view of the banknote processing unit 204 of the automatic teller machine. The automatic teller machine 300 generally includes an upper module A1, a lower module A2 and a cash chest A3, and the lower module A2 is arranged in the cash chest A3. The upper module A1 mainly includes a banknote-in/out port 1, a banknote conveying passage 2, a banknote discriminator 3, a temporary storage area 4 and etc. The lower module A2 mainly includes a lower conveying passage 5, a deposit box 9, and a circulation banknote box 6.

The automatic teller machine 300 is special in that the banknote-in/out port 1 and the temporary storage area thereof each employ an impeller type banknote separation device, which is described in detail by referring to FIGS. 4 to 7.

Figure 4:
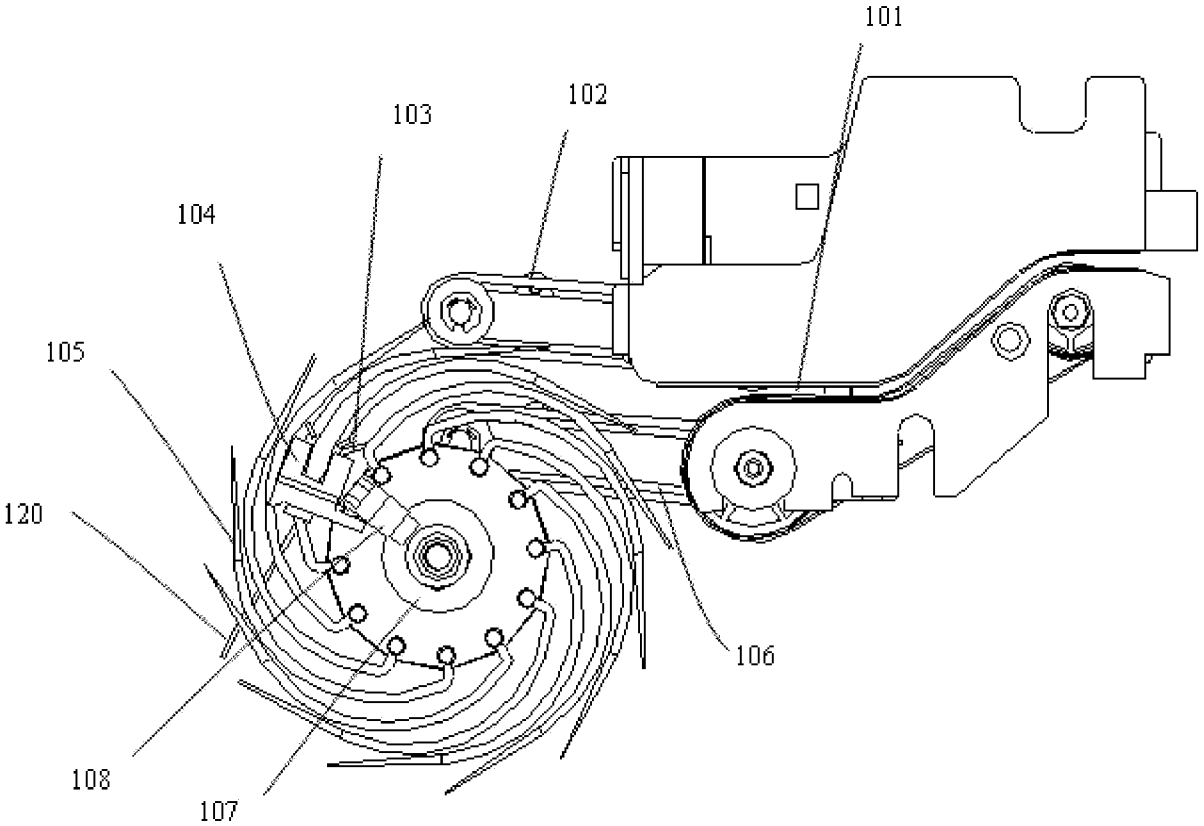
FIG. 4 is a schematic view showing a side structure of an impeller type banknote separation device.

As shown in FIG. 4, the banknote separation device includes a banknote conveying passage 101, an upper portion 102 and a lower portion 106 of the banknote conveying passage each formed by an O-shaped belt and a belt pulley, a conveying impeller 105, a U-shaped sensor 104 configured to detect the banknote, a guiding plate 103 configured to guide the banknote into the U-shaped sensor 104, a code disc 107 and a sensor 108 configured to detect a phase of the conveying impeller 105, and a banknote baffle 120.

Figure 5:
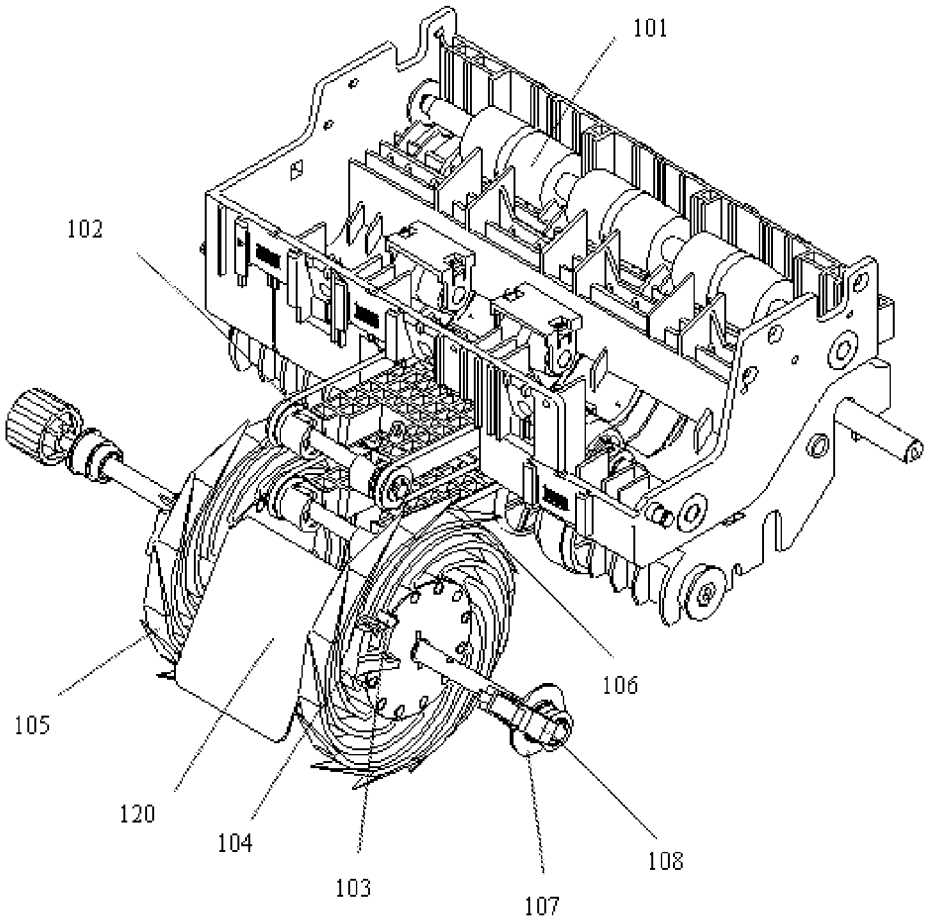
FIG. 5 is a perspective schematic view showing the structure of the impeller type banknote separation device.
Figure 6:
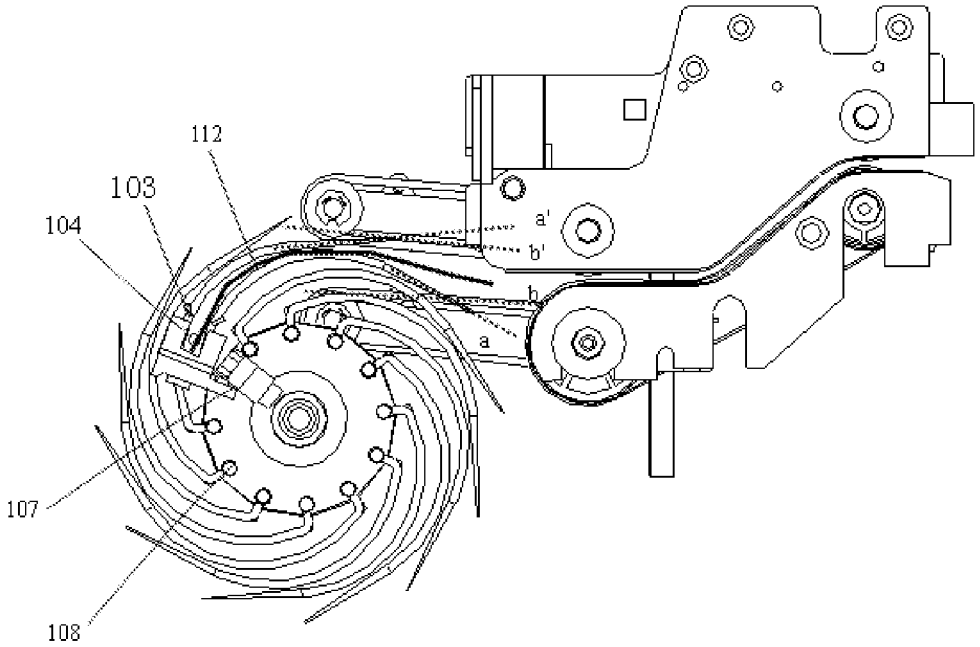
FIG. 6 is a schematic view showing entering of a banknote into a conveying impeller.

Referring to FIGS. 5 and 6, the conveying passage is driven by an external stepper motor to operate at a certain speed. The U-shaped sensor 104 controls a motor to drive the impeller 105 to rotate. Generally, the impeller 105 is in a stop state. A banknote 112 is conveyed into the impeller 105 through the conveying passage. The upper portion 102 and the lower portion 106 of the conveying passage are formed by the O-shaped belt and the belt pulley and convey the banknote into the impeller 105 at a certain speed. A space between the upper portion 102 and the lower portion 106 of the banknote conveying passage is the banknote conveying passage and is indicated by bb'. A space between extension lines aa' of tangent lines of two adjacent blades, which are closest to the banknote conveying passage, of the conveying impeller is an impeller space in which the banknote is insertable, and is indicated by aa'. The impeller space aa' intersects and overlaps with the banknote conveying passage bb' to form a closed conveying passage, thus may prevent the banknote from flying off.

Figure 7:
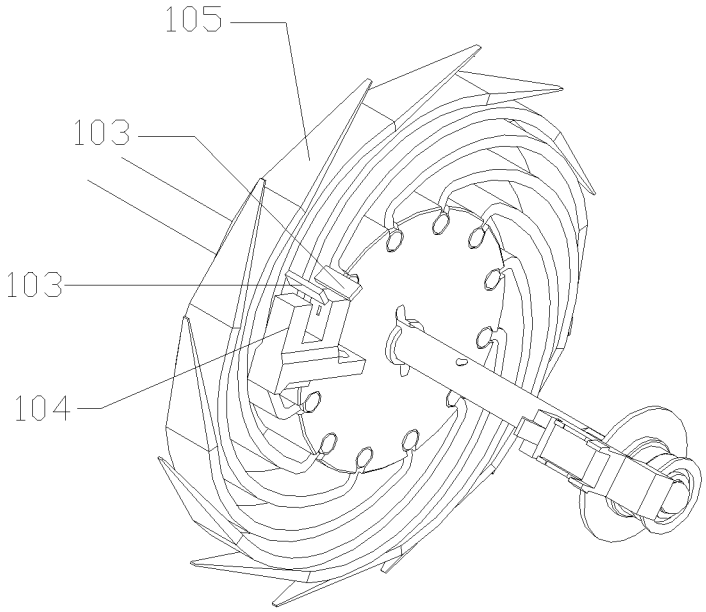
FIG. 7 shows a specific structure of the conveying impeller.

Referring to FIG. 7, the U-shaped sensor 104 is fixed at one side of the impeller 105 and rotates together with the conveying impeller. An open end of the U-shaped sensor faces a direction in which the banknote enters the impeller. Preferably, two guiding plates 103 are arranged at the open end of the U-shaped sensor, and the two guiding plates 103 are spaced from each other with a predetermined distance and are respectively inclined with a predetermined angle to form a groove having a splayed cross-section. The groove having the splayed cross-section has a groove opening with a wider opening and a groove bottom with a narrow opening, the groove opening faces to the direction in which the banknote enters the impeller, and the groove bottom faces to the open end of the U-shaped sensor. The structure of the guiding plate 103 facilitates guiding the banknote into the U-shaped sensor 104. Referring to FIG. 5, a pair of the conveying impellers 105 are generally arranged in the impeller type banknote separation device so as to form a conveying impeller group. The pair of the conveying impellers 105 are coaxially arranged in the banknote conveying passage. When the banknote enters the impeller, both ends of the banknote enter the pair of the impellers respectively. Each of, sides of the pair of conveying impellers, which face to each other, is defined as an inner side, and each of, the other sides of the pair of the conveying impellers is defined as an outer side, that is to say, a side of one conveying impeller that is close to the other conveying impeller is the inner side, and a side of one conveying impeller that is away from the other conveying impeller is the outer side. Preferably, one U-shaped sensor is fixedly mounted at the outer side of each of the pair of impellers. The impeller starts to rotate only when the U-shaped sensors of both of the impellers detect entering of the banknote. Therefore, the problems such as jamming or flying off of the banknote during the rotation of the conveying impeller in the case that the banknote is skew, may be prevented. Of course, the U-shaped sensor may be arranged at the inner side of the conveying impeller, as far as the space permits.

An operating process of the impeller type banknote separation device is described hereinafter. After entering a blade of the conveying impeller 105, the banknote 112 enters the U-shaped sensor 104 along the blade and the guiding plate 103. The code disc 107 is provided with a notch, and in the case that the optical sensor 108 configured to detect the phase of the impeller 105 is located at the notch of the code disc 107, the impeller stops. When the U-shaped sensor 104 senses entering of the banknote, the U-shaped sensor 104 is off, and the motor starts to drive the impeller to rotate. The impeller 105 makes one round, and stops when the impeller reaches the notch of the code disc 107 again, and waits for a next piece of banknote to arrive. During the rotation of the impeller 105, the banknote leaves the impeller 105 when coming into contact with the baffle 105 and falls on a platform.

The impeller 105 separates one piece of banknote in one round, and since the banknote is conveyed at a certain time interval, the time required by the impeller to make one round can be ensured. Of course, this is only one embodiment of the present application. Similarly, in the case that the rotation of the impeller 105 is accelerated, and correspondingly, two pairs of the U-shaped sensors are arranged on the impeller, two notches are provided on the code disc 107 correspondingly, and two optical sensors 108 are provided, thus the impeller 105 may separate two pieces of banknotes in one round, and the case of separating a plurality of banknotes in one round can be done in the same manner.

In the case that a peripheral linear velocity of conveying of the impeller is equal to conveying velocities of the upper and lower portions 102, 106 of the conveying passage, a distance through which the banknote moves with the rotation of the impeller is equal to a conveying distance of the upper and lower portions 102, 106 of the conveying passage. Thus, the banknote may be prevented from being pulled by the belt pulleys of the upper and lower portions 102, 106 of the conveying passage during the rotation of the impeller, and from being folded in the impeller 105 in the case that the upper and lower portions 102, 106 of the conveying passage convey the banknote too fast.

Since the U-shaped sensor is adopted to detect whether the banknote is inserted into the impeller, to control the rotation of the impeller, the impeller type banknote separation device according to the present application has a faster processing speed than a banknote separation device employing a normal optical through beam sensor. And since the U-shaped sensor can rotate together with the conveying impeller, and the open end of the U-shaped sensor faces towards the direction in which the banknote enters the impeller, that is to say, the U-shaped sensor is arranged in such a way to ensure the banknote enters the U-shaped sensor, that is the banknote is completely inserted into the impeller. Thus, the technical solution of detecting whether the banknote is inserted into the impeller by the U-shaped sensor to control the rotation of the conveying impeller has a higher accuracy compared with the conventional technology, thereby preventing the banknote from flying off the impeller or being jammed during the rotation of the impeller in the case that the banknote is not completely inserted in the impeller. Further, the guiding plate is arranged at the open end of the U-shaped sensor, and the guiding plates form the groove having the splayed cross-section, thereby facilitating guiding the banknote into the U-shaped sensor. Moreover, the closed conveying passage is formed between the banknote conveying passage and the impeller space, thus further preventing the banknote from flying off the impeller.

The embodiments described hereinabove are only preferred embodiments of the present application. It should be noted that, the above preferred embodiments should not be interpreted as limitation to the present application, and the scope of the present application should be defined by the claims. For those skilled in the art, a few of improvements and modifications may be made to the present application without departing from the spirit and scope of the present application, and these improvements and modifications are also deemed to fall into the scope of the present application.

The invention claimed is:

1. An impeller type banknote separation device, comprising a conveying impeller configured to separate banknotes, an impeller phase detecting sensor and a banknote conveying mechanism, the conveying impeller having a plurality of blades uniformly distributed in a spiral radial form, wherein the impeller type banknote separation device further comprises at least one U-shaped sensor fixed on the conveying impeller and configured to detect whether a banknote enters the conveying impeller, the U-shaped sensor comprises a signal transmitting end and a signal receiving end located at a same side of the conveying impeller, the signal transmitting end and the signal receiving end are spaced from each other with a certain interval and form an open end of the U-shaped sensor, and the open end of the U-shaped sensor faces to a direction in which the banknote enters the conveying impeller.

2. The impeller type banknote separation device according to claim 1, wherein two guiding plates are arranged at the open end of the U-shaped sensor, the two guiding plates are spaced from each other with a predetermined distance and are respectively inclined at a predetermined angle to form a groove having a splayed cross-section, the groove having the splayed cross-section comprises a groove opening having a wide opening and a groove bottom having a narrow opening, the groove opening faces to a direction in which the banknote enters the conveying impeller, and the groove bottom faces to the open end of the U-shaped sensor.

3. The impeller type banknote separation device according to claim 1, wherein the banknote conveying mechanism comprises an O-shaped belt and a belt pulley configured to convey the banknote, and the O-shaped belt and the belt pulley form a banknote conveying passage and are powered by a stepper motor.

4. The impeller type banknote separation device according to claim 3, wherein a space between extension lines of tangent lines of, the two adjacent blades closest to the banknote conveying passage of the conveying impeller, is an impeller space into which the banknote is insertable, and the impeller space and the banknote conveying passage intersect or overlap with each other to form a closed conveying passage.

5. The impeller type banknote separation device according to claim 4, wherein the impeller type banknote separation device comprises a pair of conveying impellers coaxially arranged in the banknote conveying passage, and one U-shaped sensor is fixedly mounted on at least one side of each of the pair of conveying impellers.

6. The impeller type banknote separation device according to claim 2, wherein the banknote conveying mechanism comprises an O-shaped belt and a belt pulley configured to convey the banknote, and the O-shaped belt and the belt pulley form a banknote conveying passage and are powered by a stepper motor.

7. A financial self-service equipment, comprising a banknote-in/out port, a banknote discriminator, a temporary storage area, a deposit box, a circulation banknote box and a banknote conveying passage, wherein at least one of the banknote-in/out port and the temporary storage area is provided with an impeller type banknote separation device comprising a conveying impeller configured to separate banknotes, an impeller phase detecting sensor and a banknote conveying mechanism, the impeller type banknote separation device further comprises at least one U-shaped sensor fixed on the conveying impeller and configured to detect whether a banknote enters the conveying impeller, the U-shaped sensor comprises a signal transmitting end and a signal receiving end located at a same side of the conveying impeller, the signal transmitting end and the signal receiving end are spaced from each other with a certain interval and form an open end of the U-shaped sensor, and the open end of the U-shaped sensor faces to a direction in which the banknote enters the conveying impeller.

8. The financial self-service equipment according to claim 7, wherein two guiding plates are arranged at the open end of the U-shaped sensor, the two guiding plates are spaced from each other with a predetermined distance and are respectively inclined at a predetermined angle to form a groove having a splayed cross-section, the groove having the splayed cross-section comprises a groove opening having a wide opening and a groove bottom having a narrow opening, the groove opening faces to a direction in which the banknote enters the impeller, and the groove bottom faces to the open end of the U-shaped sensor.

9. The financial self-service equipment according to claim 7, wherein the banknote conveying mechanism comprises an O-shaped belt and a belt pulley configured to convey the banknote, and the O-shaped belt and the belt pulley form a banknote conveying passage and are powered by a stepper motor.

10. The financial self-service equipment according to claim 9, wherein a space between extension lines of tangent lines of the two adjacent blades closest to the banknote conveying passage of the conveying impeller, is an impeller space into which the banknote is insertable, and the impeller space and the banknote conveying passage intersect or overlap with each other to form a closed conveying passage.

11. The financial self-service equipment according to claim 10, wherein the impeller type banknote separation device comprises a pair of conveying impellers coaxially arranged in the banknote conveying passage, and one U-shaped sensor is fixedly mounted on at least one side of each of the pair of conveying impellers.

12. The financial self-service equipment according to claim 8, wherein the banknote conveying mechanism comprises an O-shaped belt and a belt pulley configured to convey the banknote, and the O-shaped belt and the belt pulley form a banknote conveying passage and are powered by a stepper motor.

* * * * *